US005148916A

United States Patent [19]

Tillyer, Sr.

[11] Patent Number: 5,148,916

[45] Date of Patent: Sep. 22, 1992

[54] RAZOR BLADE CARRIER

[76] Inventor: John N. Tillyer, Sr., 64 Middle St., Saco, Me. 04072

[21] Appl. No.: 765,443

[22] Filed: Sep. 25, 1991

[51] Int. Cl.[5] ..... A45C 11/26

[52] U.S. Cl. ..... 206/352; 206/38; 206/228; 206/472; 206/818

[58] Field of Search ..... 206/38, 38.1, 228, 352, 206/354, 359, 818, 472

[56] References Cited

U.S. PATENT DOCUMENTS

| | | | |
|---|---|---|---|
| 1,607,602 | 11/1926 | Bindseil | 206/352 |
| 1,654,554 | 1/1928 | Pasch | 206/818 |
| 1,733,971 | 10/1929 | Kremer | 206/352 |
| 1,986,230 | 1/1935 | Talbot | 206/354 |
| 2,321,570 | 6/1943 | Billing | 206/818 |
| 2,628,712 | 2/1953 | Ford | 206/38.1 |
| 2,849,109 | 8/1958 | Rommel | 206/352 |
| 3,111,152 | 11/1963 | Goessling | 206/38.1 |
| 3,212,546 | 10/1965 | Lind | 206/818 |
| 3,727,658 | 4/1973 | Eldridge, Jr. | 206/818 |
| 4,013,109 | 3/1977 | Sandel | 206/818 |
| 4,095,691 | 6/1978 | Iten | 206/354 |
| 4,167,230 | 9/1979 | Barratt | 206/818 |
| 4,373,629 | 2/1983 | Ulin et al. | 206/818 |
| 4,632,250 | 12/1986 | Ueda et al. | 206/818 |
| 4,681,223 | 7/1987 | Roberts | 206/354 |
| 4,741,434 | 5/1988 | Liebman | 206/38.1 |
| 4,964,508 | 10/1990 | Balsley | 206/38.1 |
| 5,060,794 | 10/1991 | Linn et al. | 206/38.1 |

FOREIGN PATENT DOCUMENTS

| | | | |
|---|---|---|---|
| 294298 | 7/1928 | United Kingdom | 206/818 |

*Primary Examiner*—David T. Fidei
*Attorney, Agent, or Firm*—William Nitkin

[57] ABSTRACT

A razor blade carrier utilizing two hingeably attached strips of magnetically attractive material between which is sandwiched the razor blade to be carried.

4 Claims, 2 Drawing Sheets

RAZOR BLADE CARRIER

BACKGROUND OF THE INVENTION

1. Field of the Invention

The device of this invention resides in the area of structures to carry razor blades safely and more particularly relates to a portable device for the carrying of a single-edge razor blade safely upon one's person or among other effects.

2. Description of the Prior Art

Single-edge razor blades have an extremely sharp edge and if carried loosely can injure an individual or otherwise cause damage. It is desirable when carrying such blades that they be encased in their original packing cardboard member or otherwise contained within a holder. Often when these blades are used, their original protective packaging is misplaced and it is very difficult to find any suitable container in which to safely store such blades so that they will not cause injury.

SUMMARY OF THE INVENTION

It is an object of this invention to provide an improved type of single-edge razor blade carrier constructed of two strips of flexible, magnetically attractive material being hinged in a book-like format and when closed being of a size somewhat larger than a single-edge blade. The single-edge razor blade is positioned against one of said magnetic strips and magnetically attracted thereto since the blade is metal. The second magnetically attractive strip member is hingeably attached to the first magnetically attractive strip member and closes over the blade, covering it so that such strip is not only attracted to the blade which is magnetic from its contact with the first strip but also the two magnetic strips are attracted to one another, securely retaining the razor blade therebetween.

DESCRIPTION OF THE PREFERRED EMBODIMENT(S)

Figure 1:
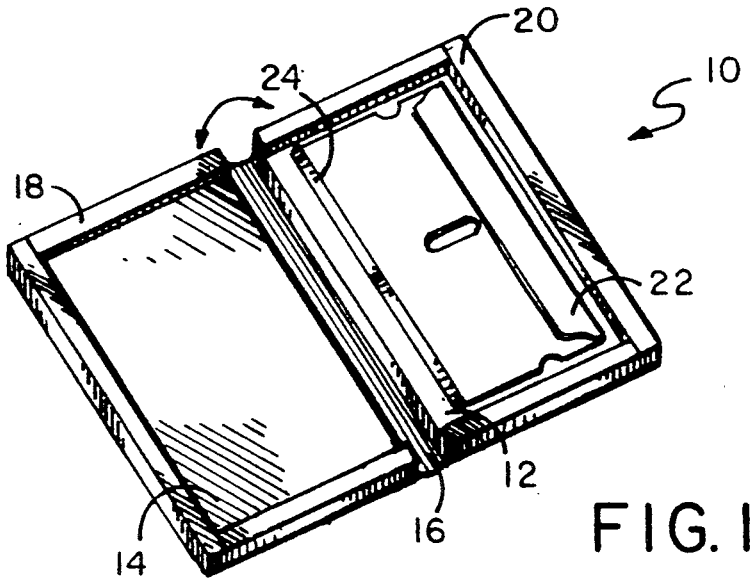
FIG. 1 illustrates a perspective view of the single-edge razor blade carrier of this invention in its open mode with the blade positioned therein.
Figure 2:
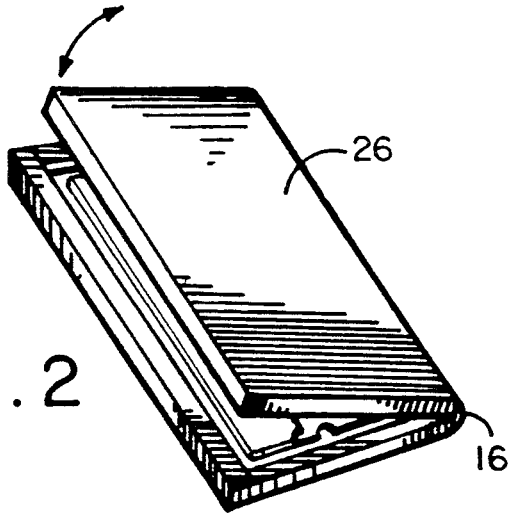
FIG. 2 illustrates the carrier of this invention being closed over a blade.
Figure 3:
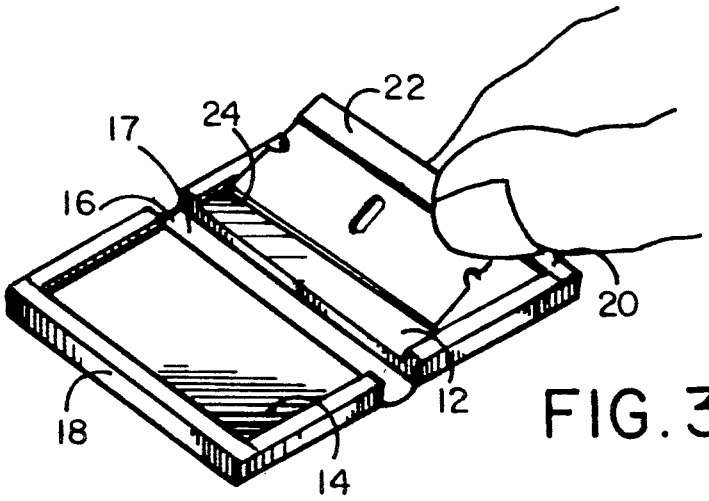
FIG. 3 illustrates the carrier of this invention with the blade being positioned onto one of the magnetically attractive strips.

In the preferred embodiment of the single-edge blade carrier 10 of this invention first and second magnetic strips 12 and 14 composed of any well-known flexible magnetic material sold in elongated strips are provided which strips are interconnected by flexible hinge member 16. In FIG. 3 is seen blade 22 which is positioned with its sharp end 24 near the junction of hinge member 16, and the blade is then allowed to be pulled by magnetic attraction toward first magnetic strip 12. Once it is in position so that none of the blade protrudes beyond the sides of first magnetic strip material 12, the size of the magnetic strip material being shaped to be larger than the size of the blade, the second magnetic strip 14 is rotated as seen in FIG. 2 and closes over the blade with second magnetic strip 14 being magnetically attracted to first magnetic strip 12, securely retaining the blade therebetween. The structure of this invention can be carried safely in one's pocket as the blade will not move or shift within the carrier of this invention.

In one embodiment first and second magnetic strips 12 and 14 can be joined by a piece of adhesive tape forming hinge member 16 therebetween having a cover 17 seen in FIG. 3 placed between the two adjacent magnetic strips to avoid having the tape's adhesive surface exposed within the flexible hinge 16. In some embodiments the tape's edges 18 and 20 can be folded around and adhered to the outer edges of magnetic strips 12 and 14. In this embodiment when the blade is placed onto first magnetic strip 12, the edges form the perimeter of an indented receipt area and further assist in confining and positioning the blade within first and second magnetic strips 12 and 14 which are closed around the blade when the blade is placed therein for storage.

Figure 4:
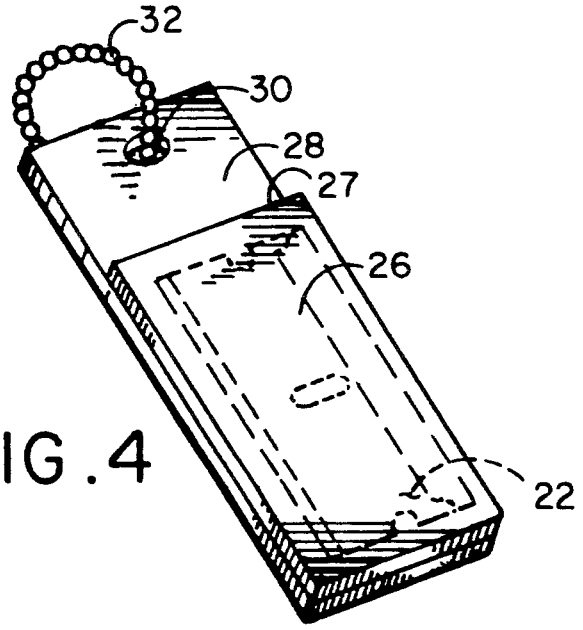
FIG. 4 illustrates the carrier of this invention where on of the sides of the carrier has an aperture defined therein, for example, to be retained on a key chain.

FIG. 4 illustrates an embodiment of the carrier of this invention where one magnetic strip extends beyond the other. Blade 22 is positioned between upper portion 26 which is closed over lower portion 28 of the strip material, but lower portion 28 extends upward beyond the end 27 of upper portion 16 and has an aperture 30 formed therein which can, for example, have keychain 32 passing therethrough so that the structure of the razor blade carrier of this invention can be easily carried on a keychain.

Figure 5:
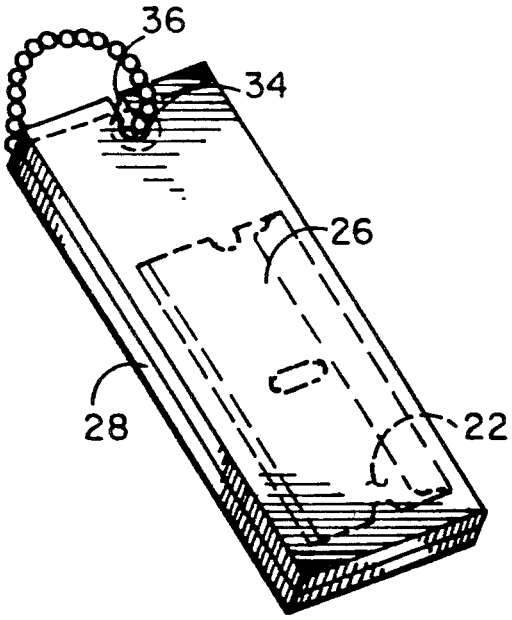
FIG. 5 illustrates an alternate embodiment of the carrier of FIG. 4.

FIG. 5 illustrates a further alternate embodiment of the device of this invention which can be held on a keychain. Upper portion 26 in this embodiment extends upward covering lower portion 28. Upper portion 26 has an aperture defined therein corresponding to aperture 30 defined in lower portion 28. A slot 36 is provided between aperture 34 and the upper edge of upper portion 26. In use, because of the soft nature of the magnetic strip material, upper portion 26 can be opened with keychain 32 passing through slot 36. In the same manner when this embodiment is closed, keychain 32 which is already held and retained in aperture 30 of lower portion 26 as it is closed over blade 22 onto lower portion 28. In some embodiments where apertures are provided in magnetic strip material, a grommet around the aperture can be utilized to provide additional strength.

Although the present invention has been described with reference to particular embodiments, it will be apparent to those skilled in the art that variations and modifications can be substituted therefore without departing from the principles and spirit of the invention.

I claim:

1. A single-edge razor blade carrier for carrying a single-edge razor blade, comprising:

a first piece of magnetically attractive strip material having inner and outer sides and edges defining a size somewhat larger than said razor blade to be carried;

a second piece of magnetically attractive strip material having inner and outer sides and edges defining a size somewhat larger than said razor blade to be carried;

a flexible hinge member joining said first and second pieces of magnetically attractive strip with said razor blade being positionable with its blade toward said flexible hinge member and with said second piece of magnetically attractive strip material being closable over said razor blade positioned therein to completely sandwich said razor blade between said inner sides of said first and second pieces of magnetically attractive strip material to form a protective housing for retaining said razor blade securely therein;

wherein said hinge member is formed of a tape positioned on the outer sides of said magnetically attractive strip material; and wherein said flexible tape extends around and folds over the edges onto the inner sides of said first and second pieces of magnetically attractive strip material to form a recessed area defined by said tape on the inner sides of said strip material of a size large enough to receive said razor blade.

2. The razor blade carrier of claim 1 wherein one of said pieces of magnetically attractive strip material extends upward beyond the other and has an aperture defined therein for receipt of objects.

3. A single-edge razor blade carrier for carrying a single-edge razor blade, comprising:

a first piece of magnetically attractive strip material having edges defining a size larger than said razor blade to be carried;

a second piece of magnetically attractive strip material having edges defining a size larger than said razor blade to be carried;

a flexible hinge member joining said first and second pieces of magnetically attractive strip with said razor blade being positionable with its blade toward said flexible hinge member and with said second piece of magnetically attractive strip material being closed over said razor blade positioned therein to sandwich said razor blade between said first and second pieces of magnetically attractive strip material to form a protective housing for retaining said razor blade securely therein; and wherein both of said pieces of magnetic material extend upwards beyond the position of said razor blade therein, the first piece of magnetic strip material having an aperture defined therein in said extending portion, the second piece of strip material having an aperture defined therein corresponding in position to the aperture in said first piece of strip material, said second piece of strip material further including a slot defined therein between said aperture and an edge of said strip material, said apertures adapted for the receipt of objects wherein upon opening, said first piece of strip material from said second piece material said object can pass from said aperture defined in said second piece of strip material through said slot to allow said second piece of strip material to be swung, away on its hinge from said first piece of strip material to expose the blade receipt area between said first piece of strip material and said second piece of strip material.

4. The razor blade carrier of claim 1 wherein both of said pieces of magnetic material extend upwards beyond the position of said razor blade therein, the first piece of magnetic strip material having an aperture defined therein in said extending portion, the second piece of strip material having an aperture defined therein corresponding in position to the aperture in said first piece of strip material, said second piece of strip material further including a slot defined therein between said aperture and an edge of said strip material, said apertures adapted for the receipt of objects wherein upon opening, said first piece of strip material from said second piece of strip material said object can pass from said aperture defined is said second piece of strip material through said slot to allow said second piece of strip material to be swung away on its hinge from said first piece of strip material to expose the blade receipt area between said first piece of strip material and said second piece of strip material.

* * * * *